US006810641B2

(12) United States Patent
Ausnit

(10) Patent No.: US 6,810,641 B2
(45) Date of Patent: Nov. 2, 2004

(54) METHOD AND APPARATUS FOR FORMING DOUBLE ZIPPER BAGS

(75) Inventor: Steven Ausnit, New York, NY (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/044,858

(22) Filed: Nov. 13, 2001

(65) Prior Publication Data

US 2003/0089084 A1 May 15, 2003

(51) Int. Cl.[7] ..... B65B 9/02; B65B 61/18; B31B 1/90

(52) U.S. Cl. ..... 53/412; 53/450; 53/453; 53/133.4; 53/550; 53/562; 53/553; 493/213

(58) Field of Search ..... 53/453, 562, 553, 53/133.4, 139.2, 412, 450, 550, 202; 493/213, 214, 927

(56) References Cited

U.S. PATENT DOCUMENTS 3,219,084 A * 11/1965 Ausnit ..... 24/585.12
3,554,822 A * 1/1971 Schwarzkopf ..... 53/477
3,853,671 A * 12/1974 Ausnit ..... 24/585.12
4,437,293 A 3/1984 Sanborn, Jr.
4,651,504 A * 3/1987 Bentsen ..... 53/412
4,892,512 A * 1/1990 Branson ..... 493/214
5,096,516 A * 3/1992 McDonald et al. ..... 493/214
5,100,246 A 3/1992 LaPierre et al.
5,105,603 A 4/1992 Natterer
6,110,090 A * 8/2000 Ausnit ..... 493/213
6,131,369 A * 10/2000 Ausnit ..... 53/139.2
6,138,436 A * 10/2000 Malin et al. ..... 53/133.4
6,138,439 A * 10/2000 McMahon et al. ..... 53/412
6,212,857 B1 * 4/2001 Van Erden ..... 53/412
6,327,837 B1 * 12/2001 Van Erden ..... 53/412
6,360,513 B1 * 3/2002 Strand et al. ..... 53/412
6,427,421 B1 * 8/2002 Belmont et al. ..... 53/412
6,494,018 B1 * 12/2002 Vanderlee et al. ..... 53/133.4
6,526,726 B1 * 3/2003 Strand et al. ..... 53/133.4

* cited by examiner

*Primary Examiner*—John Sipos
(74) *Attorney, Agent, or Firm*—Pitney Hardin LLP

(57) ABSTRACT

A method and apparatus for continuously forming and filling slider operated reclosable plastic bags two at a time. A base film of plastic bag making material is horizontally advanced in a longitudinal direction and product is loaded onto the base film in two lines. First and second continuous slider operated zippers are then applied onto the base film between the lines of product and a cover film is placed over the base film covering the lines of product and the zippers. The composite is sealed to the base film along longitudinally extending lines disposed on sides of the product opposite to the two zippers and between the zippers. The base film is then sealed to the cover film along transverse seal sections on opposite sides of each row of product and the thus formed filled packages are separated by longitudinally cutting through the base film between the zippers and cutting through the transverse seal sections.

20 Claims, 8 Drawing Sheets

METHOD AND APPARATUS FOR FORMING DOUBLE ZIPPER BAGS

BACKGROUND OF THE INVENTION

The present invention relates to the manufacture and filling of zipper packages on horizontal form fill and seal (HFFS) machines and, in particular to a method for forming such packages two-at-a-time so as to improve production rates and reduce production costs.

It has heretofore been proposed to form and fill packages on HFFS equipment. Such equipment is particularly well suited for the packaging of solid objects such as block or sliced cheese, cold cuts and the like. It has further been proposed to package such items in zippered packaging so as to facilitate the storage and containment of any unused portions of the package after the package is initially opened. Such a method and apparatus is depicted, for example, in U.S. Pat. No. 6,185,907. While such packaging has many apparent benefits a disadvantage is the associated cost which is at least partially due to the production rates and capital expense required to set up the production lines. The problems become complicated where, in addition to a zipper the package is to include a slider to facilitate opening and closing the zipper.

SUMMARY OF THE INVENTION

The present invention is a method and apparatus for continuously forming and filling reclosable plastic bags, which include sliders, two at a time. In accordance with the disclosed method a base film of plastic bag making material is horizontally advanced in a longitudinal direction of the film web. The product to be packaged is transversely loaded onto the base film in first and second longitudinally extending lines with the products of the first line aligned with those of the second line. First and second continuous zippers are then applied onto the base film between the lines of product, each of the zippers comprising first and second profiles having mating interlocking portions. Sliders are provided on the zippers between zipper stops formed at bag width intervals. A cover film of plastic bag making material is placed over the base film covering the lines of product and the zippers. The cover film is joined to the base film along longitudinally extending lines disposed on sides of the product opposite to the two zippers. In this connection the cover film may be a separate web in which case the edges of the base film and cover film would be sealed together or the base film and cover film may be formed of a common web with the portions defining the cover folded over the portions defining the base. The first profile of each of the first and second zippers is attached to the base film, the second profile of each of said first and second zippers is attached to the cover film and the base film is attached to the cover film between the first and second zippers. The base film is then sealed to the cover film along transverse seal sections on opposite sides of each row of product running through the zipper stops. The thus formed and filled packages are separated by longitudinally cutting through the base film between the zippers and cutting through the transverse seal sections.

DETAILED DESCRIPTION OF THE PREFERRED EMBODIMENT

Figure 1:
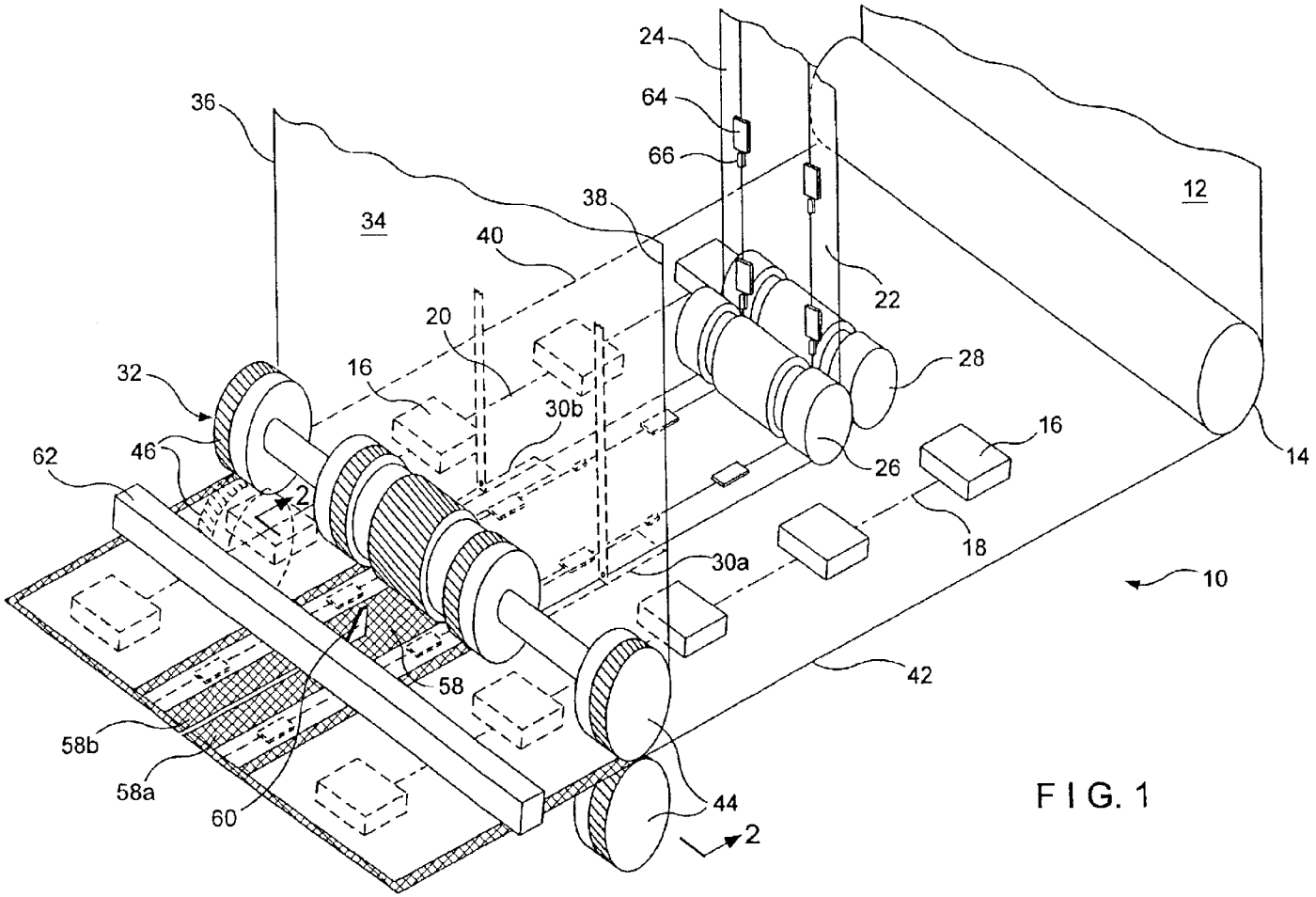
FIG. 1 is a simplified perspective view of a HFFS machine in accordance with the present invention.

Reference is now made to the drawings and to FIG. 1 in particular wherein a HFFS apparatus 10 in accordance with the present invention is depicted. A base film 12 is fed under roller 14 to move horizontally in the longitudinal direction of the base film web under the action of drive rollers (not shown). At a filling location, product 16 is placed on the moving base film in two parallel lines (whose center lines are designated 18 and 20) extending in the longitudinal direction with the products in the two lines being transversely aligned with each other.

Figure 2:
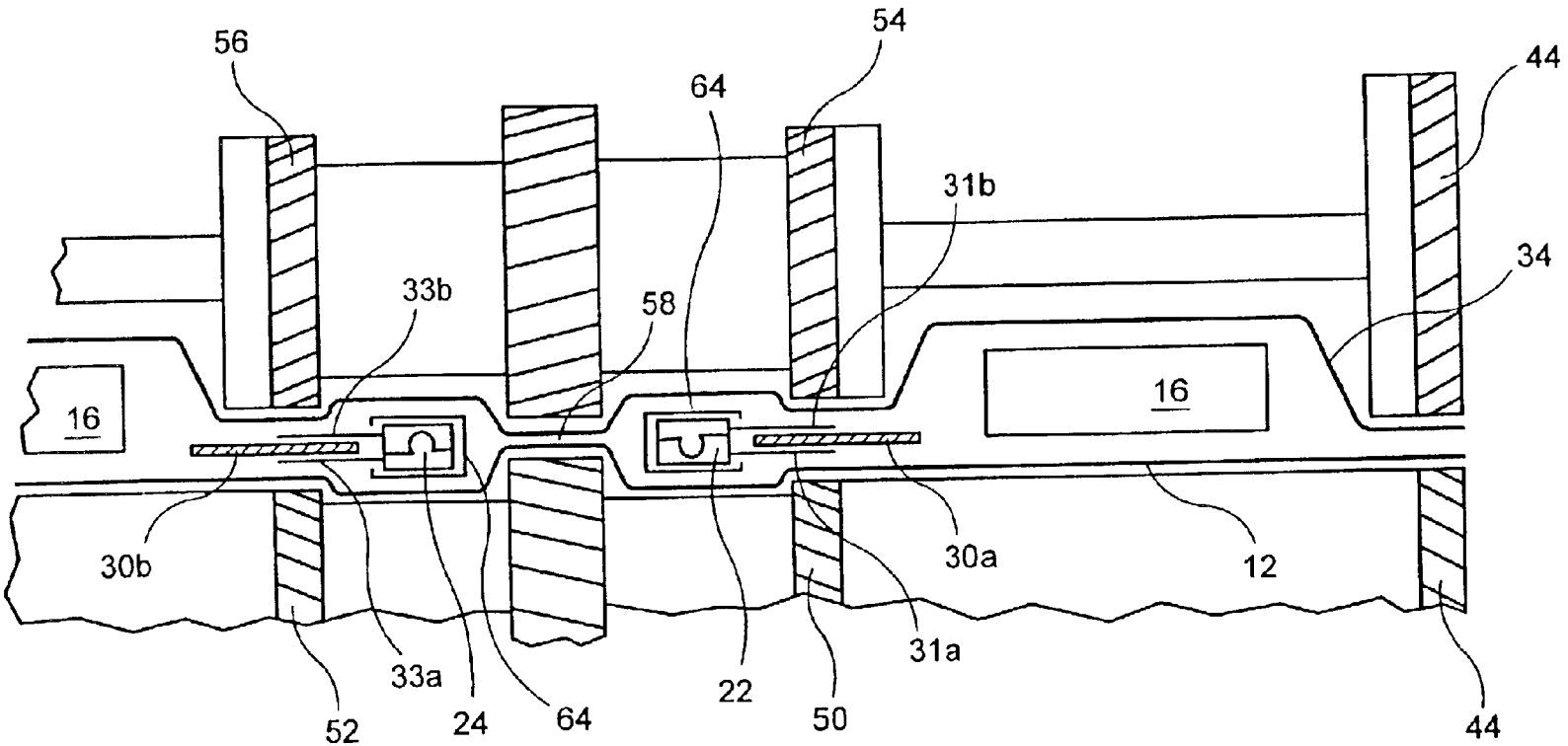
FIG. 2 is sectional view taken along reference lines 2—2 of FIG. 1 in the direction indicated by the arrows.
Figure 3:
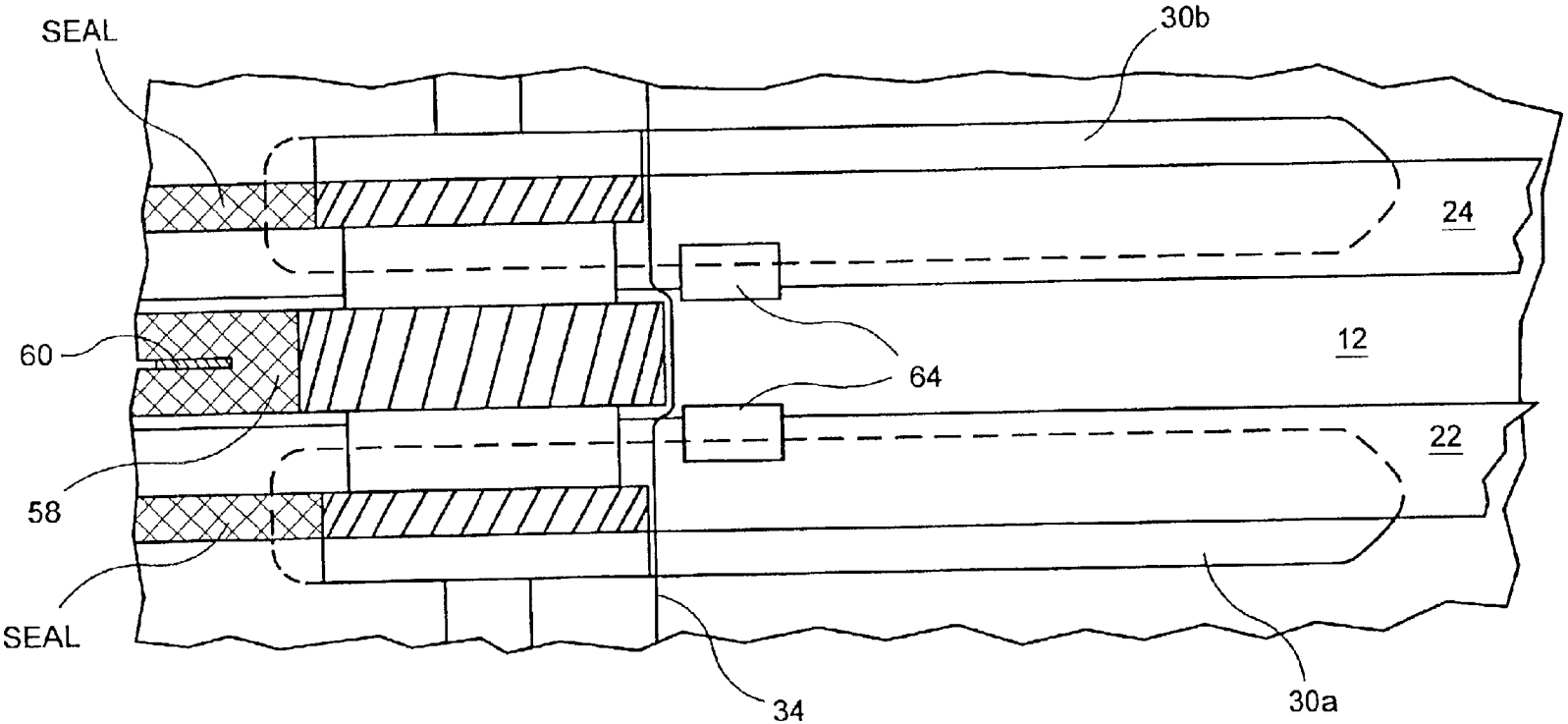
FIG. 3 is a fragmented top plan view of the bag forming section of the HFFS equipment of FIG. 1.

A first continuous zipper 22 and a second continuous zipper 24 are fed via and between guide rollers 26 and 28 onto the base film between product lines 18 and 20. Each of the zippers includes a pair of profiles including complementary interlocking portions that are mated with one another in the customary fashion. The zippers are oriented on the base film with one of the profiles overlying the other profile. Each of the profiles further includes a flange and the flanges 31*a* and 31*b* and 33*a* and 33*b* of zippers 22 and 24, respectively are separated by separator guides 30*a* and 30*b*, respectively, as the base film and zippers move toward a sealing station 32 as shown in FIG. 2. The separator guides serve to align the zippers with the sealing heads and prevent the flanges from sealing together, thereby avoiding the necessity for closely controlled temperatures. At the entrance to the sealing station 32 a cover film 34 is fed over the base film covering the lines of product 18, 20 as well as the zippers 22, 24. Alternatively the zippers could be placed on the outsides of the product lines rather than between the product lines.

At the sealing station 32 several things happen. The longitudinal edges 36, 38 of the cover film 34 are sealed to the longitudinal edges 40, 42 of the base film by heated sealing rollers 44, 46. The flanges 31*a*, 33*a* of the lower profiles of zippers 22, 24 are sealed to the base film 12 with heated rollers 50, 52 while the flanges 31*b*, 33*b* of the upper profiles of zippers 22, 24 are sealed to the cover film with heated rollers 54, 56. Finally, at a location between zippers 22 and 24 a joined section 58 is formed by sealing cover film 34 to base film 12.

Figure 7:
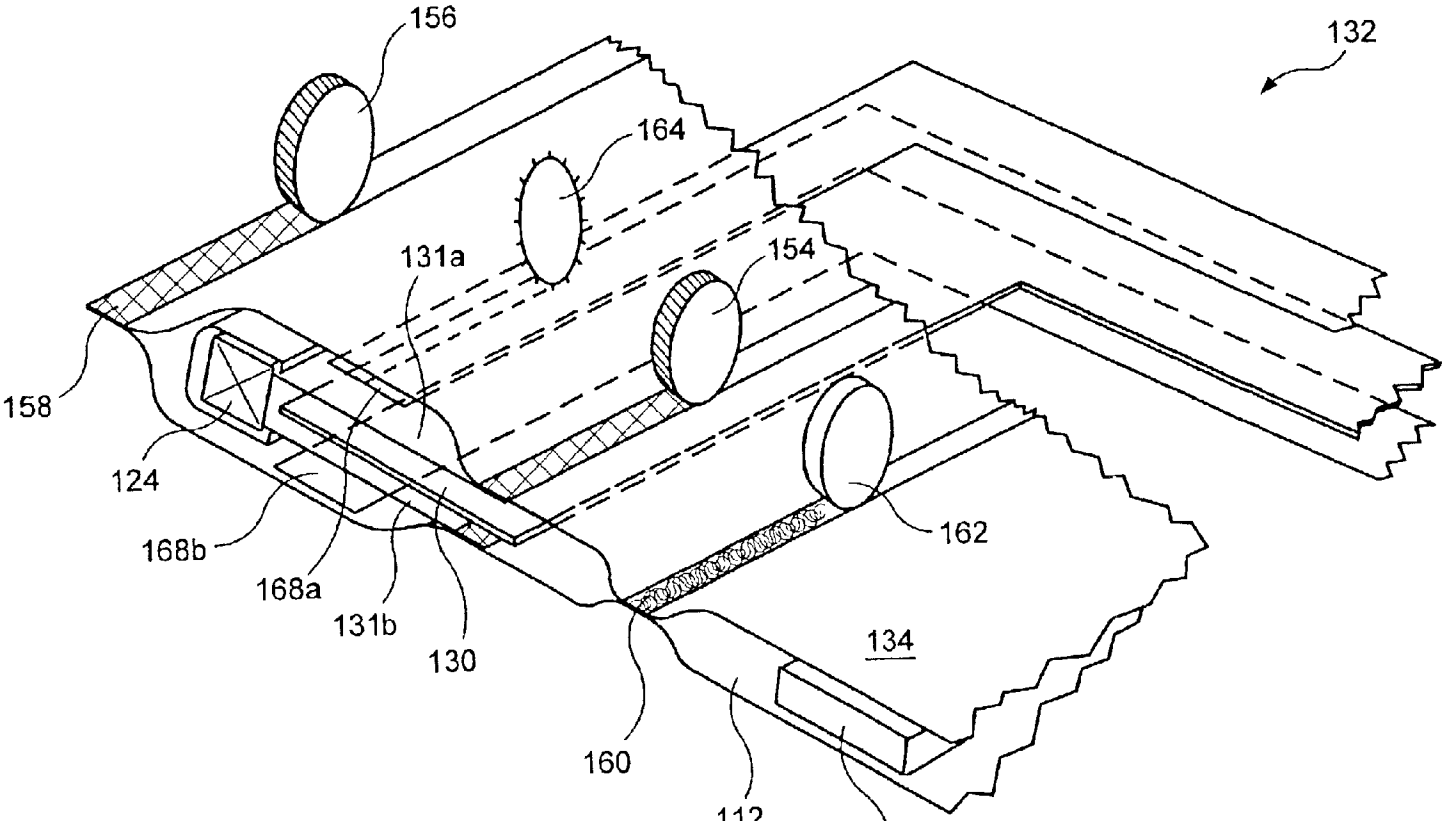
FIG. 7 is a fragmentary perspective view of an alternative construction for the sealing station utilized in the present invention, for simplicity only half of the section being depicted.
Figure 8B:
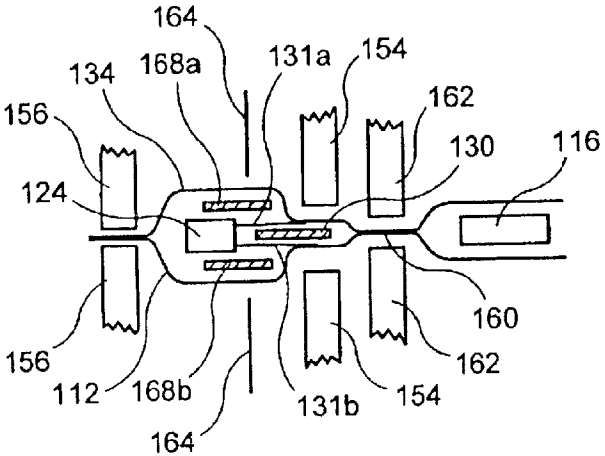
FIGS. 8A and 8B schematically depict the sealing arrangements, for simplicity only half of the section being depicted.
Figure 8A:
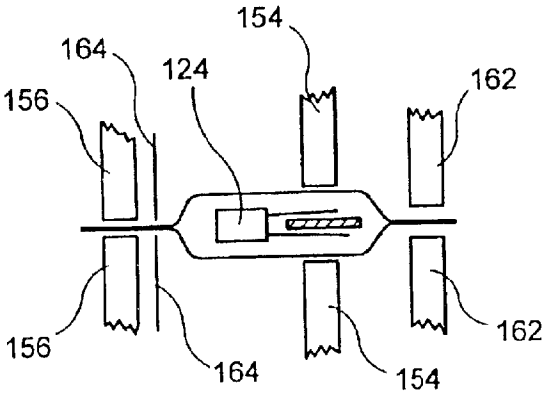

An alternative sealing station 132 is depicted in FIGS. 7 and 8B. In accordance with this embodiment, a hard seal between the zippers is formed by sealing rollers 156 to join the cover film and the base film. The zipper flanges 131*a* and 131*b* are respectively sealed to the cover film 134 and base film 112 by rollers 154 acting from opposite sides against separator guide 130. The cover film 134 and base film 112 are sealed to one another with a peel seal 160 by sealing rollers 162 below the flanges so that the envelope for product 116 may be hermetically sealed. To facilitate opening the finished package, a pair of perforation rollers 164 perforate the cover film 134 and base film 112 by operating against guides 168*a* and 168*b* between the flange/film seals formed by sealing rollers 154 and the film/film seal 158 formed by rollers 156. In a slight modification shown in FIG. 8A, the perforation rollers may be moved outboard of the zipper 124 to avoid the need for guides 168*a* and 168*b*. The perforation lines allow for the creation of a tamper evident header above the zipper of the finished bag which must be removed by the consumer before the opening of the finished package. Other combinations of peel seals and lines of weakened resistance can be provided by varying the location of the hard seals, peel seals and lines of weakened resistance.

Downstream of the sealing station 32 the joined section 58 is longitudinally cut by cutter blade 60 and the individual packages are formed by cross seal/cutting bar 62 forming transverse seals across the base and cover films which are joined to each other above the zippers by the remnants 58*a* and 58*b* of joined section 58. The transverse seals are formed on both sides of the product to encase the product and separate each package from the remainder of the packages being formed.

Figure 4:
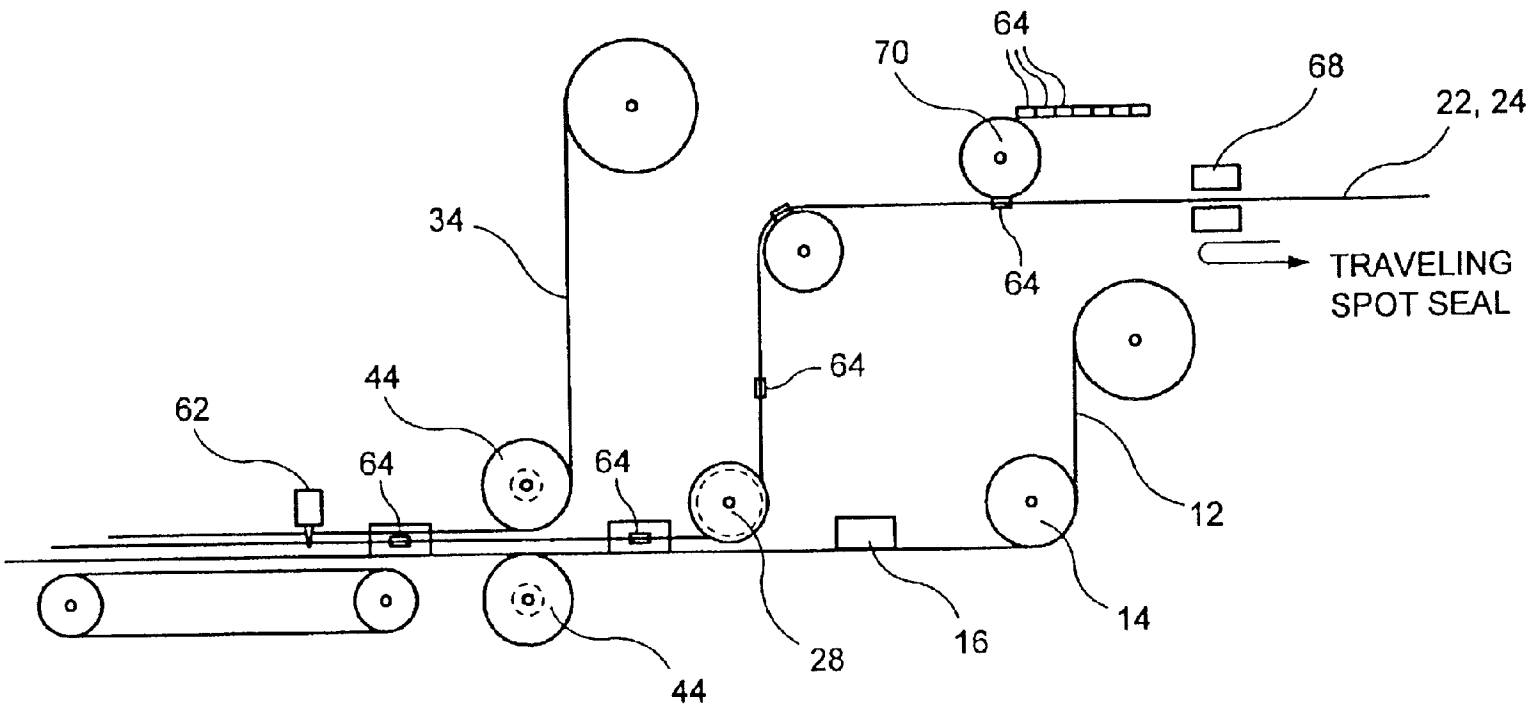
FIG. 4 is a schematic representation of a spot seal formation and slider attachment mechanism that may be used in accordance with the present invention.

The zippers 22, 24 are provided with sliders 64 each slider being mounted on the zipper between slider stops 66. The slider stops prevent the slider from running off the zipper at the full open and full closed position. To this end, each adjacent pair of slider stops is spaced apart by a distance equal to the width of a bag to be formed and the HFFS machine is programmed so that the cross seal/cutting bar 62 cuts through the formed end stop thereby leaving a portion of each end stop in the lagging side of the bag being formed and a portion in the leading side of the next bag to be formed. As shown in FIG. 4, the end stops 66 for each zipper 22, 24 are formed by a traveling spot sealer 68, such as an ultra-sonic sealer, that spot fuses the two interlocking portions and surrounding material of the zipper profiles together while traveling with the zipper so as not to interrupt the line. The fused portions define the end-stops 66 by interrupting the zipper track to prevent further movement of the slider. After the spaced spot seals are formed a slider is attached to the zipper 22, 24 by attaching mechanism 70. Alternatively, the spot seals and sliders could be intermittently formed and attached in which case a dancer roller arrangement would be used to convert the intermittent movement of the zipper to the continuous movement through the HFFS machine.

Figure 5A:
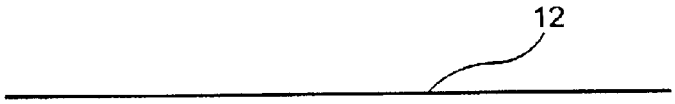
FIGS. 5A–5F schematically depict the steps of forming reclosable packaging in accordance with the present invention from base and cover films supplied from separate rolls.
Figure 5B:
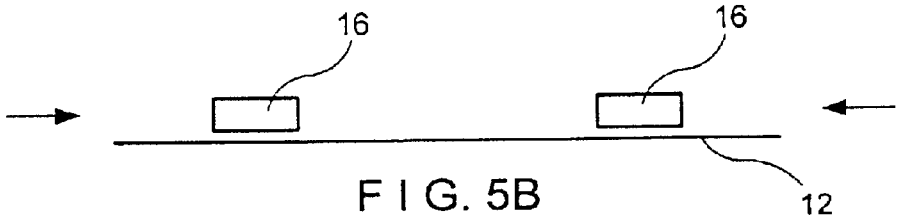
Figure 5C:
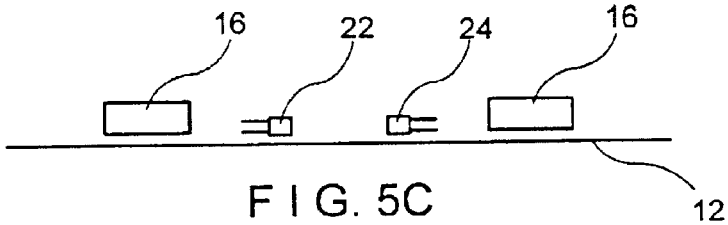
Figure 5D:
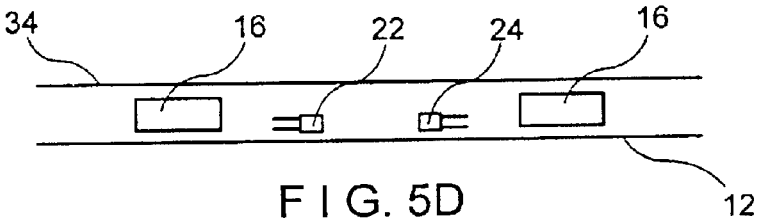
Figure 5E:
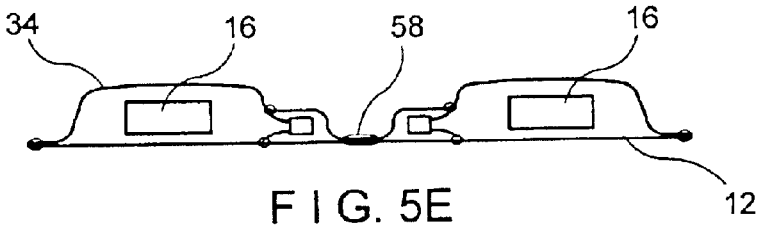
Figure 5F:
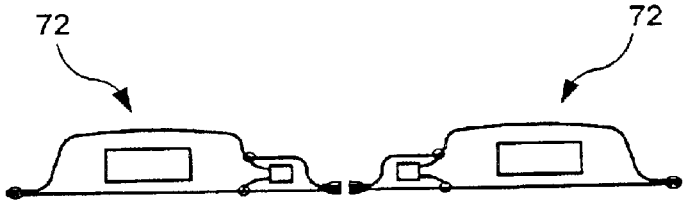

Referring to FIGS. 5A–5F, it can be seen that as the base film 12 advances product 16 is deposited onto the base film. Two lines of zipper, 22, 24 with attached sliders are then deposited on the base film between the product and the base film with product is then covered by cover film 32. The zippers are sealed to and between the base and cover films. The edges of the base and cover film are sealed together as is a section 58 between the zippers. The transverse seals are then formed to produce two head-to-head packages as shown in FIG. 5E and the individual filled packages 72 are then separated from one another.

Figure 6A:
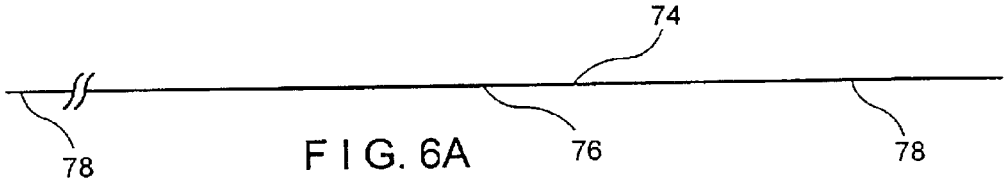
FIGS. 6A–6F schematically depict the steps of forming reclosable packaging in accordance with the present invention from base and cover films supplied from a common roll.
Figure 6B:
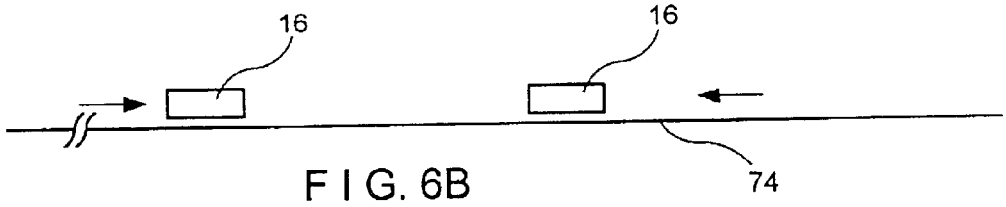
Figure 6C:
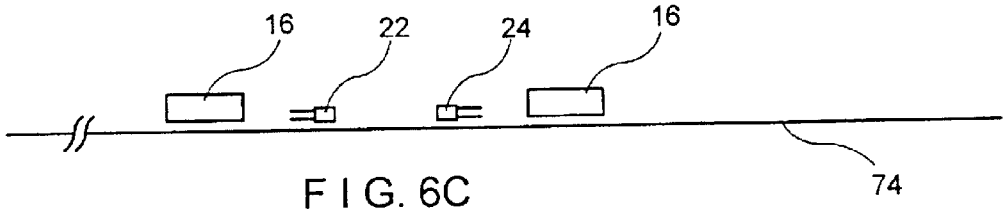
Figure 6D:
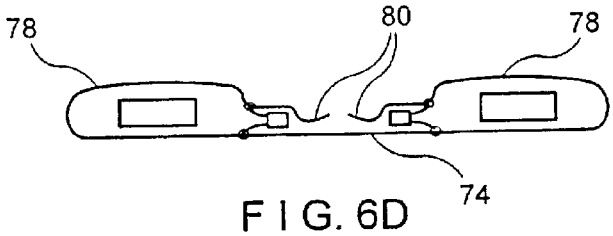
Figure 6E:
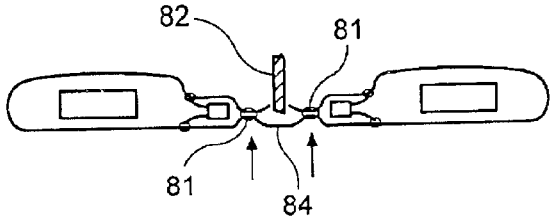
Figure 6F:
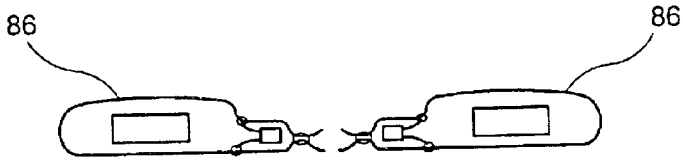

Reference is now made to FIGS. 6A–6F, wherein a modification of the method described above and depicted in FIGS. 5A–5F is shown. In accordance with the modification, a combined film 74 is longitudinally advanced. The film 74 is "combined" in that it is sufficiently wide to include a center section 76 and side portions 78 on opposite sides of the center section. The product 16 and zippers 22, 24 are loaded onto the center section where-after the side portions 78 are folded over the center section each side portion encasing its associated line of products and zipper. It will be appreciated that the center section 76 now serves as the base film and the side portions 78 serve as the cover film of the previous embodiment. The marginal edge sections 80 of the side portions 78 are then sealed to the center section as the flanges of the profiles of the zippers 22, 24 are sealed to the side portions and center section as shown in FIG. 6F. This may be by a conventional "hard" seal or with a peel seal line 81. During the sealing process the free edges of the marginal edge sections 80 are kept apart by separator 82. The center section is then longitudinally cut between the seals 81 and the transverse seals and cuts are formed as before to produce the desired separated packages 86.

Figure 9:
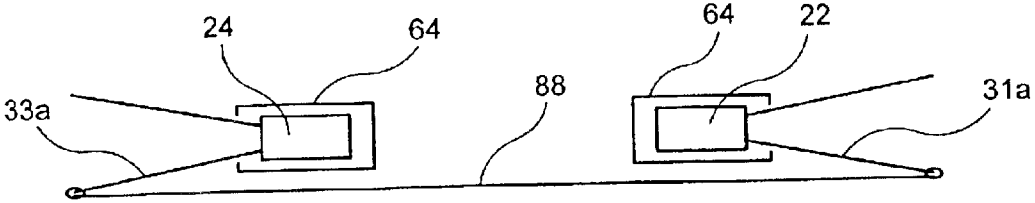
FIGS. 9 and 10 schematically depict alternative zipper arrangements that may be used practicing the present invention.
Figure 10:
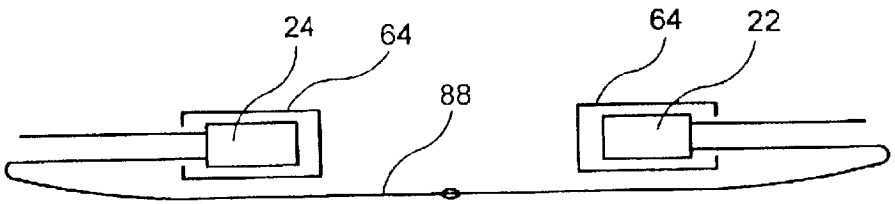

As shown in FIGS. 9 and 10, to facilitate feeding and attaching the zippers 22 and 24 the bottom flanges 31*a* and 33*a* may be joined to a common web 88 which, in turn is attached to the base film 12, as shown in FIG. 9. In FIG. 10 the flanges 31*a* and 31*b* are formed somewhat longer, bent 180° and then joined to one another to form a common web which is then attached to the base film.

Having thus described the invention, what is claimed is:

1. A method of forming and filling reclosable plastic bags comprising the steps of:

continuously advancing a base film of plastic bag making material horizontally in a longitudinal direction of said base film;

loading product in first and second longitudinally extending lines onto said base film at spaced apart bag length intervals, the products on said lines being disposed in transversely aligned rows;

applying first and second zippers onto said base film between said lines of product, each of said zippers comprising first and second profiles having mating interlocking portions, and second flanges extending from respective said first and second profiles; and a slider for opening and closing said profiles applying a cover film of plastic bag making material over said base film covering said lines of product and said zippers, said cover film being joined to said base film along longitudinally extending lines disposed on sides of said product opposite to said first and second zippers;

joining a first portion of a width of the first flange of each of said first and second zippers to said base film whereby a second portion of the width of the first flange of each of said first and second zippers is free of joinder to said base film, and joining a first portion of the width of the second flange of each of said first and second zippers to said cover film whereby a second portion of a width of the second flange of each of said first and second zippers is free of joinder to said cover film;

longitudinally joining said base film to said cover film between said first and second zippers;

sealing said base film to said cover film along transverse seal sections on opposite sides of each row of product, said transverse seal sections extending between said longitudinally extending lines joining said base film to said cover film;

longitudinally cutting through said base film between said two zippers; and cutting through said transverse seal sections to release filled reclosable bags.

2. The method in accordance with claim 1 wherein said base film is sealed to said cover film simultaneously with said zipper profiles being sealed to said base and cover film.

3. The method in accordance with claim 1 comprising the further step of joining said base film to said cover film with a peel seals between each of zippers' mating interlocking portions and said longitudinally extending lines of products.

4. The method in accordance with claim 1 comprising the further step of forming longitudinally extending lines of weakness between the locations at which said base film is longitudinally joined to said cover film and the locations where said zipper profiles are joined to said base and cover films.

5. The method in accordance with claim 1 wherein said transverse seal sections are cut as said base film is sealed to said cover film.

6. The method in accordance with claim 1 comprising the further step of shaping said first and second zippers at bag width intervals to form slider stops and positioning a slider between each pair of stops.

7. The method in accordance with claim 6 wherein said first and second zippers are applied to said base film with each of said stops aligned with said transverse seal sections.

8. The method in accordance with claim 1 wherein said first flange of said first zipper is joined to said first flange of said second zipper to form a common web and said common web is attached to said base film.

9. The method in accordance with claim 1 wherein said base film and said cover film are separately supplied and said base film is sealed to said cover film along said longitudinally extending lines disposed on sides of said product opposite to said zippers.

10. The method in accordance with claim 1 wherein said base film comprises a center section of a common film and said cover film comprises side portions of said common film folded over said center section along longitudinally extending fold lines whereby longitudinally extending free edges of said side portions are positioned between said first and second zippers.

11. The method in accordance with claim 10 wherein said cover film is joined to said base film by longitudinally extending peel seals positioned between said free edges and said first and second zipper.

12. An apparatus for forming and filling reclosable plastic bags comprising:

means for horizontally advancing a base film of plastic bag making material continuously in a longitudinal direction of said base film;

means for transversely loading product in first and second longitudinally extending lines onto said base film at spaced apart bag length intervals, the products on said lines being disposed in transversely aligned rows;

means for applying first and second zippers onto said base film between said lines of product, each of said zippers comprising first and second profiles having mating interlocking portions, and second flanges extending from respective said first and second profiles; and a slider for opening and closing said profiles means for applying a cover film of plastic bag making material over said base film covering said lines of product and said zippers, said cover film being joined to said base film along longitudinally extending lines disposed on sides of said product opposite to said first and second zippers;

means for joining a first portion of a width of the first flange of each of said first and second zippers to said base film whereby a second portion of a width of the first flange of each of said first and second zippers is free of joinder to said base film and joining a first portion of a width of the second flange of each of said first and second zippers to said cover film whereby a second portion of a width of the second flange of each of said first and second zippers is free of joinder to said cover film;

means for sealing said base film to said cover film along transverse seal sections on opposite sides of each row of product, said transverse seal sections extending between said longitudinally extending lines joining said base film to said cover film;

means for longitudinally cutting through said base film between said two zippers; and means for cutting through said transverse seal sections to release filled reclosable bags.

13. The apparatus in accordance with claim 12 further comprising means for applying sliders to said first and second zippers disposed upstream of said means for applying said first and second zippers onto said base film.

14. The apparatus in accordance with claim 12 further comprising means for shaping said first and second zippers at bag width intervals to form slider stops wherein said slider applying means positions one of said sliders between each pair of stops.

15. The apparatus in accordance with claim 12 wherein said base film and said cover film are separately supplied and further comprising means for sealing said base film to said cover film along longitudinally extending lines disposed on sides of said product opposite to said zippers.

16. The apparatus in accordance with claim 12 wherein said base film comprises a center section of a common film and said cover film comprises side portions of said common film and further comprising means for folding said side portions over said center section along longitudinally extending fold lines and for guiding longitudinally extending free edges of said side portions between said first and second zippers.

17. The apparatus in accordance with claim 12 further comprising a guide separator between said base and cover film for separating said the first and second profiles of said first zipper from one another as said profiles are joined to said base film and said cover film.

18. The apparatus in accordance with claim 12 further comprising means for forming longitudinally extending lines of weakness between the locations at which said base film is longitudinally joined to said cover film and the locations where said zipper profiles are joined to said base and cover films.

19. The apparatus in accordance with claim 18 further comprising a first guide separator between said base and cover film for separating the flanges of said the first and second profiles of said first zipper from one another as said profiles are joined to said base film and said cover film; and second and third guide separators respectively aligned with said means for forming longitudinally extending lines of weakness between the locations at which said base film is longitudinally joined to said cover film and the locations where said zipper profiles are joined to said base and cover films.

20. The method in accordance with claim 1 wherein said first and second flanges of said first zipper are oriented in a direction opposite to a direction in which said first and second flanges of said second zipper are oriented.

* * * * *